US005534131A

United States Patent [19]

Zoppi

[11] Patent Number: 5,534,131

[45] Date of Patent: Jul. 9, 1996

[54] PROCESS FOR HEAVY METALS ELECTROWINNING

[75] Inventor: Gianni Zoppi, Dino di Sonvico, Switzerland

[73] Assignee: Ecochem Aktiengesellschaft, Liechtenstein

[21] Appl. No.: 524,438

[22] Filed: Sep. 6, 1995

[30] Foreign Application Priority Data

Sep. 8, 1994 [CH] Switzerland ..... 02746/94

[51] Int. Cl.[6] ..... C25D 1/16; C25D 1/08

[52] U.S. Cl. ..... 205/560; 205/536; 205/574; 205/602; 205/587

[58] Field of Search ..... 205/574, 602, 205/587, 560, 536

[56] References Cited

FOREIGN PATENT DOCUMENTS 2739970 3/1978 Germany .
2163101 2/1986 United Kingdom .

*Primary Examiner*—John Niebling
*Assistant Examiner*—Alex Noguerola
*Attorney, Agent, or Firm*—Cushman Darby & Cushman

[57] ABSTRACT

The conditions for electrowinning Zn, Ni, Co and Cd metals from baths based on chlorinated ammino complexes of $Me(NH_3)_nCl_m$ type are substantially improved by the addition of small levels of dissolved Br, which considerably reduce the cell voltage without exerting any negative effects on cathodic current yields.

7 Claims, No Drawings

PROCESS FOR HEAVY METALS ELECTROWINNING

The copending U.S. patent application of Zoppi, No. 08/235,914, filed May 2, 1994 relates to a process for electrowinning a metal Me selected from Zn, Ni, Co and Cd which yields an ammino-chlorinated complex of $Me(NH_3)_nCL_m$ type which, in aqueous solution, is submitted to electrolysis inside a cell not provided with separation diaphragms or membranes between anodes and cathodes, with a pure metal deposit and nitrogen development being obtained at the cathode and at the anode, respectively. Nitrogen derives from the oxidation of ammonia contained in the bath by chlorine formed at anode. The pH value of the bath is kept comprised within the range of from 6 to 8, with ammonia being added to the bath.

The present Applicant has surprisingly found now that the process disclosed in said patent application can be improved in terms of reduction in cell voltage, and hence, of energy saving.

With the main chemical and electrochemical features of the cited process for electrowinning metals selected from Zn, Ni, Co and Cd remaining the same, the present invention consists in adding low levels of $Br^-$ to the electrolyte. The anodic oxidation of bromide into bromine takes place at a voltage which is approximately 300 mV lower than the necessary voltage for chloride conversion into chlorine. The Applicant could also observe that, within the pH range taken into consideration, ammonia contained in the bath is oxidized with $N_2$ being produced according to the overall reaction:

$$3Br_2+2NH_3 \rightarrow 6Br^-+N_2+6H^+$$

with a very fast kinetics as compared to the analogous reaction disclosed in the above cited copending U.S. patent application i.e.

$$3Cl_2+2NH_3 \rightarrow 6Cl^-+N_2+6H^+.$$

Therefore, the presence of a low level of bromide in the bath (comprised within the range of from 1 to 10 g/l of $Br^-$) makes it possible for the cell voltage to be considerably reduced and consequently a considerable energy saving being achieved in metal electrowinning.

In order to illustrate the present invention without limiting it, the following examples are supplied.

EXAMPLE 1 (COMPARISON EXAMPLE)

An amount of 250 g of pure zinc oxide was dissolved in 5 l of aqueous solution containing 250 g/l of $NH_4Cl$, and the resulting solution was heated up to 60° C.

The solution was then fed to an electrolytic cell with a graphite anode and a titanium sheet cathode, without any separator means between anode and cathode. Through this cell, a current of 10 A was flown during 6 hours and the voltage reading at the electrodes was of 2.52 V on an average, with temperature being kept comprised within the range of from 60°±2 and the pH value being kept comprised within the range of from 6 to 8, by gradually adding $NH_3$ solution.

An amount of 70.1 g of zinc was obtained with a current efficiency of 95.7%.

The calculated d.c. (direct current) energy consumption was of 2.16 Kwh/kg of Zn.

EXAMPLE 2

To a similar solution to the preceding one, 2 g/l of $Br^-$ as KBr, heated at 60° C., was added.

On complete dissolution, the resulting solution was charged to an electrolytic cell with a graphite anode and a titanium plate cathode, not separated by a membrane diaphragm.

Through the cell a current of 10 A was flown during 6 hours, at an average voltage value of 2.27 V.

The solution was kept at 60+2/−0° C. and at pH of 6–8 by means of the addition of a total amount of 38 g of 31% $NH_3$ solution.

An amount of 69.5 g of Zn was obtained, with a current efficiency of 94.9%.

The calculated d.c. energy consumption was of 1.96 Kwh/kg of Zn.

EXAMPLE 3

An amount of 500 g of technical ZnO, with commercial purity, was dissolved in 10 l of an aqueous solution containing 250 g of $NH_4Cl$ per liter and 10 g of $Br^-$ per liter, and heated at 60° C.

After being purified with 2.5 g of Zn powder, which cements the small impurities of Cu, Pb and Cd, always present in commercial oxides, the solution was sent, after being preliminarily filtered, to the electrolytic cell of the preceding example, kept at 62 ±2° C. throughout the test run.

A current of 10 A was flown during 24 hours and the average voltage reading through the cell was of 2.21 V.

During the test, 152 g of an aqueous solution containing 31% $NH_3$ was gradually added in order to keep the pH value of the bath comprised within the range of from 6 to 8.

The deposited Zn amount was of 280.5 g.

The current efficiency was 95.8%.

The calculated d.c. energy consumption was of 1.89 Kwh/kg of Zn.

From the above examples, it will be seen that already with the introduction of 2 g/l of Br, an energy saving of 0.2 Kwh of zinc is obtained, whilst when 10 g/l of $Br^-$ is present, an energy saving of 0.27 Kwh/kg of zinc is obtained.

Larger amounts of Br ion do not cause any further decrease in cell voltage.

I claim:

1. Process for producing Me metals selected from copper, zinc, nickel, cadmium and cobalt, in which the corresponding water-soluble metal-ammino complex $Me(NH_3)_nCl_m$ is formed and said complex is submitted, in aqueous solution, to electrolysis inside a cell with no separation means between anode and cathode, characterized in that to said aqueous solution, bromide ion is added.

2. Process according to claim 1, characterized in that said bromide ion is added in a concentration comprised within the range of from 1 to 10 g/l.

3. Process according to claim 1, characterized in that said ammino complex $Me(NH_3)_nCl_m$ is directly submitted to electrolysis.

4. Process according to claim 1, characterized in that said ammino complex is formed by reacting a suitable compound of said metal and ammonia, or ammonium chloride, and the so formed ammino complex is submitted to said electrolysis.

5. Process according to claim 1, characterized in that during said electrolysis at cathode said metal Me is deposited with $NH_3$ being released, at the anode bromide is oxidized into elemental bromine and the latter reacts with said ammonia released at the cathode and migrated to the region surrounding the anode according to the reaction:

$$3Br_2+2NH_3 \rightarrow 2N_2+6Br^-+6H^+$$

with $N_2$ thus being developed at the anode.

6. Process according to claim 5, characterized in that said ammonia oxidized into nitrogen gas is replenished in the electrolyte by keeping the pH value constantly controlled within the approximate pH range of from 6 to 8.

7. Apparatus for electrowinning a metal, Me, selected from the group consisting of Zn,Ni,Co and Cd, from an ammino—chlorinated complex of $Me(NH_3)_nCl_m$, wherein m and n are whole numbers, to obtain a deposit of pure Me at a cathode and nitrogen at an anode, comprising:

an electrolysis cell having a cathode and an anode at least partly immersed in an electrolyte which is in free communication between the cathode and anode, without interposition of a separation diaphragm and membrane;

said electrolyte having a pH within the range of 6 to 8, a temperature in the range of 58° C. to 62° C. and containing, in addition to an aqueous solution of said complex, from 1 to 10 g/l of $Br^-$; and an electrical potential of 10 amps and 2.21–2.52 volts applied across said anode and cathode.

* * * * *